US005398460A

United States Patent [19]

Joncour

[11] Patent Number: 5,398,460

[45] Date of Patent: Mar. 21, 1995

[54] METHOD FOR CHECKING THAT LENSES TO BE FITTED TO AN EYEGLASS FRAME MATCH THE CONTOUR OF THE RIMS OR SURROUNDS OF THE FRAME

[75] Inventor: Christian Joncour, Saint Maurice, France

[73] Assignee: Essilor International Cie Generale d'Optique, Creteil Cedex, France

[21] Appl. No.: 154,001

[22] Filed: Nov. 18, 1993

[30] Foreign Application Priority Data

Dec. 18, 1992 [FR] France ..... 92 15299

[51] Int. Cl.[6] ..... B24B 1/00

[52] U.S. Cl. ..... 451/42; 451/43; 451/54; 451/240

[58] Field of Search ..... 51/281 R, 284 R, 284 E, 51/323, 326, 327, 101 LG

[56] References Cited

U.S. PATENT DOCUMENTS

| | | | |
|---|---|---|---|
| 4,524,419 | 6/1985 | Headlund et al. | 51/284 E |
| 4,596,091 | 6/1986 | Daboudet | 51/101 LG |
| 4,829,715 | 5/1989 | Langlois et al. | 51/284 E |
| 4,885,875 | 12/1989 | Soper | 51/284 E |
| 5,155,940 | 10/1992 | Suzuki | 51/101 LG |
| 5,161,333 | 11/1992 | Lecerl et al. | 51/284 E |
| 5,321,915 | 6/1994 | Lecerl et al. | 51/100 LG |
| 5,333,412 | 8/1994 | Matsuyama | 51/101 LG |

FOREIGN PATENT DOCUMENTS

| | | |
|---|---|---|
| 0235021 | 9/1987 | European Pat. Off. . |
| 0274276 | 7/1988 | European Pat. Off. . |
| 0379427 | 7/1990 | European Pat. Off. . |
| 2543039 | 9/1984 | France . |

*Primary Examiner*—Maurina T. Rachuba
*Attorney, Agent, or Firm*—Young & Thompson

[57] ABSTRACT

A method of checking that a lens suits an eyeglass frame uses the lens grinding machine itself. The lens to be ground is mounted on a support shaft and moved into contact with the grinding wheel with the latter stationary. The support shaft is rotated stepwise until the lens to be ground has rotated through one complete turn. A check is carried out to determine whether a feeler associated with a template is operated thereby during such rotation. The invention finds an application in grinding machines used to trim eyeglass lenses.

4 Claims, 1 Drawing Sheet

METHOD FOR CHECKING THAT LENSES TO BE FITTED TO AN EYEGLASS FRAME MATCH THE CONTOUR OF THE RIMS OR SURROUNDS OF THE FRAME

BACKGROUND OF THE INVENTION

1. Field of the Invention

The present invention concerns a method for checking that lenses to be fitted to an eyeglass frame match the contour of the rims or surrounds of the frame.

2. Description of the Prior Art

Eyeglass lenses are manufactured is the form of circular, elliptical or other shape blanks of different sizes which must be trimmed by grinding them to suit the contour of the rims or surrounds of the eyeglass frame to which they are to be fitted.

They are usually trimmed on a grinding machine comprising at least one grinding wheel rotating on a frame, a carriage pivoting on the frame about an axis parallel to the rotation axis of the grinding wheel, a support shaft rotating on the carriage about an axis parallel to the rotation axis of the grinding wheel and which is adapted to receive axially the lens to be ground and a template, and a feeler in vertical alignment with the template mounted on the frame to move transversely to the pivot axis of the carriage.

The template may have a contour identical to that of the rims or surrounds of the eyeglass frame to be fitted with the lens, for example, and when it comes into contact with the associated feeler, which in this case serves as an abutment, it interrupts the movement of the lens into engagement with the grinding wheel due entirely to the weight of the carriage or to the combined effect of its weight and spring, counterbalance or like means. In this way the trimming of the lens at the corresponding location is limited to the required contour.

As an alternative to this the template is round and in this case the associated feeler is acted on by control means which, responsive to the contour of the rims or surrounds of the eyeglass frame to be fitted with the lens, command a displacement causing pivoting of the carriage in one direction or the other so as to adjust the trimming of the lens appropriately at the required locations.

In all cases the practitioner must first choose a lens of adequate size, in other words a lens whose contour is sure to encompass all that of the rim or surround to be fitted with the lens, taking into account the centering which is required when the lens is mounted in the rim or surround.

Various ancillary control devices for this specific purposes have already been proposed.

They are usually simple centering devices which before the lens is attached to the holding block by means of which it is then fitted to the supporting shaft of the grinding machine enable superimposition according to the required centering of an image of the contour of the lens to be fitted and an image of the contour of the rim or surround of the eyeglass frame to which it is to be fitted, so providing a visual check that the lens is suitable for this rim or surround.

As an alternative to this, European patent No 0 379 427 discloses two sensors which are moved over the lens, one on each side, along the contour of the rim or surround of the eyeglass frame to which the lens is to be fitted. A warning signal is sent if the thickness sensed by the sensors along this contour become zero or less than a predetermined limit thickness, so indicating that the selected lens is too small or off-centre.

These devices are in addition to the instrumentation strictly required for trimming the lenses, with attendant cost penalties.

In the absence of such devices the suitability of the lens can be verified by calculation.

However, the calculation is somewhat complicated except for circular contour lenses.

An object of the present invention is a method which provides an economical way of using the grinding machine alone to check the appropriateness of the lens without using any ancillary devices and without requiring any calculations.

SUMMARY OF THE INVENTION

The invention consists in a method of checking that a lens suits an eyeglass frame using a grinding machine comprising at least one grinding wheel rotating on a frame, a carriage pivoting on said frame about an axis parallel to the rotation axis of said grinding wheel, a support shaft rotating on said carriage about an axis parallel to the rotation axis of said grinding wheel and adapted to receive axially said lens to be ground and a template, and a feeler vertically aligned with said template, in which method said lens to be ground is mounted on said support shaft and moved into contact with said grinding wheel with the latter stationary, said support shaft is rotated stepwise until said lens to be ground has rotated through one complete turn, and a check is carried out to determine whether said feeler associated with said template is operated thereby during such rotation.

If this is so, and assuming that the centering is correct, the lens is not of a suitable size.

The various operations of the method in accordance with the invention can easily be integrated into a special working cycle or sensing cycle of the grinding machine to be executed prior to any grinding cycle. The invention therefore provides a very fast way of using the grinding machine alone to check that the selected lens is appropriate without excessive handling operations, without requiring the use of any other device and relying entirely on the existing components of the grinding machine.

In other words, the invention has the advantage of assigning to the grinding machine, in addition to its usual specific functions, an additional function of checking that the selected lens is appropriate.

The features and advantages of the invention will emerge from the following description given by way of example with reference to the appended diagrammatic drawings.

DETAILED DESCRIPTION OF THE INVENTION

Figure 1:
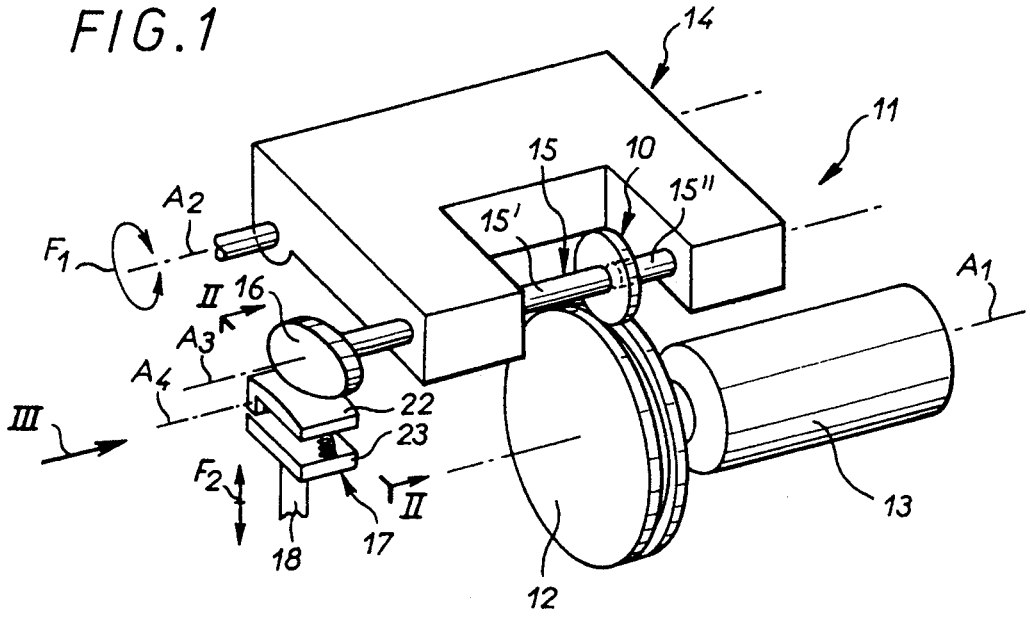
FIG. 1 is a perspective view of a grinding machine implementing the method in accordance with the invention.

The grinding machine 11 conventionally comprises at least one grinding wheel 12 driven by a motor 13 and rotating on a frame (not shown) about a rotation axis A1 represented by a chain-dotted line in FIG. 1. A carriage 14 is pivoted on the frame to pivot as shown by the double-headed arrow F1 in FIG. 1 about an axis A2 also represented as a chain-dotted line in FIG. 1 and parallel to the rotation axis A1 of the grinding wheel 12. A support shaft 15 rotates on the carriage 14 about an axis A3 also shown as a chain-dotted line in FIG. 1 and also parallel to the rotation axis A1 of the grinding wheel 12. This shaft is adapted to receive axially the lens 10 to be ground, to this end comprising two half-shafts 15', 15'' adapted to grip between them, the lens 10 mounted on a handling block, and a template 16 vertically aligned with a feeler 17. These latter arrangements are described in more detail later.

The grinding machine 11 is, for example, of the type described in U.S. Pat. No. 4,596,091.

As the grinding machine 11 is well known in itself it need not be described in further detail here.

Figure 3:
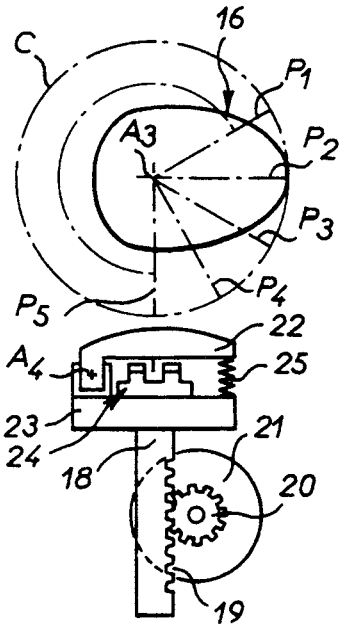
FIG. 3 is a simplified end view of the grinding machine as seen in the direction of the arrow III in FIG. 1 with a first type of template.
Figure 4:
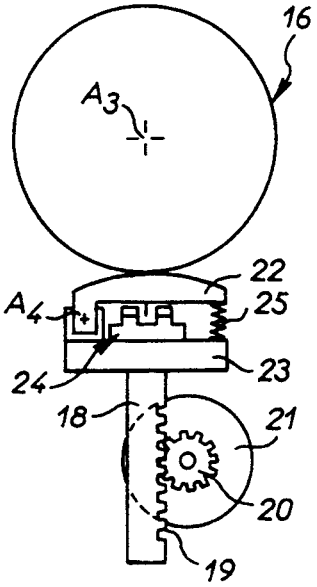
FIG. 4 is a simplified end view similar to that of FIG. 2 with a different type of template.

Suffice to say that the template 16 is disposed at the end of the support shaft 15 and that the feeler 17 associated with it is at the end of a support rod 18 which is mobile axially and which incorporates a rack 19 meshing with a pinion 20 driven by the output shaft of a motor 21 (see FIGS. 3 and 4).

The motor 21 is connected to a control unit (not shown).

The feeler 17 comprises a touchpad 22 on which the edge of the template 16 bears and whose upper surface is a cylindrical surface coaxial with and having the same diameter as the grinding wheel 12, i.e. it has a convex profile enabling it to cooperate optimally with the template 16, and a plate 23 carried by the support rod 18 on which the touchpad 22 pivots about an axis A4 parallel to the pivot axis A2 of the carriage 14. A displacement sensor 24 and a spring 25 are disposed between the touchpad 22 and the plate 23.

In a grinding machine 11 of this kind this assembly is usually called a "vernier head".

The displacement sensor 24 comprises an opto-electronic cell carried by the plate 23. A beam interrupting vane 28 carried by the touchpad 22 is inserted between the emitter 26 and the receiver 27 of the opto-electronic cell when the touchpad 22 is depressed.

Figure 2:
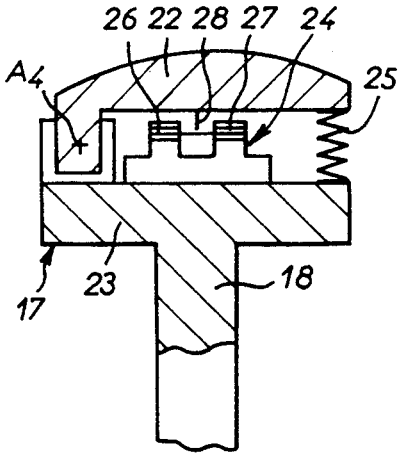
FIG. 2 is a partial view of it to a larger scale and in transverse cross-section on the line II—II in FIG. 1.

The amount by which the touchpad 22 can be depressed relative to the plate 23 has been deliberately exaggerated in FIG. 2. In practise this is a very small amount.

Two embodiments are feasible.

In a first of these (FIG. 3) the template 16 has a contour which is strictly identical at all points to that of the rim or surround of the eyeglass frame to which the lens is to be fitted.

In this case the feeler 17 is immobile and forms an abutment for the template 16. It is locked in position by the motor 21.

The lens 10 is applied to the grinding wheel 12 due to the weight of the carriage 14 and the template 16 then bears on the touchpad 22 of the feeler 17. At every point it limits the movement of the lens 10 into engagement with the grinding wheel 12 so that the lens is trimmed to its contour.

In the second embodiment (FIG. 4) the template 16 is round and it is the feeler 17 actuated by the motor 21 under the control of the aforementioned control unit which limits at each point the movement of the lens 10 into engagement with the grinding wheel 12.

For example, the control unit could output shape data transmitted to it by a contour reading device to which the rim or surround of the eyeglass frame to which the lens is to be fitted is applied. As it moves in one direction or the other the touchpad 22 of the feeler 17 operates accordingly on the rotation direction of the motor 21 through the underlying displacement sensor 24.

In all cases it is up to the practitioner to check that the lens 10 to be ground, properly centered relative to the rotation axis A3 of the support shaft 15 by the handling block applied to it for this purpose and therefore correctly centered relative to the template 16, is of an appropriate size.

In accordance with the invention this check is carried out as follows.

It will first be assumed, entirely for convenience, that the template 16 is a special-shape template (i.e. not a circular template).

When the lens 10 to be ground has been mounted on the support shaft 15 it is moved into contact with the grinding wheel 12 with the latter stationary. As diagrammatically shown in FIG. 3 by the lines $P_1$, $P_2$, $P_3$, etc relating to corresponding positions of the template 16, the support shaft 15 is rotated stepwise until the lens 10 to be ground has rotated through one complete turn.

If, as assumed in FIG. 3, the lens 10 is an appropriate size, the template 16 is spaced from the feeler 17 at all times during this rotation.

In other words, the circle C that it sweeps out during this rotation does not intersect the touchpad 22 of the feeler 17 which accordingly does not come into contact with the template 16 and therefore remains immobile, without being depressed at any stage.

The method of the invention thus checks during the single rotation of the lens 10 whether the feeler 17 is actuated by the template 16 or not.

In other words, this method checks whether the touchpad 22 of the feeler 17 is depressed by the template 16.

If it is not, the lens 10 is of an appropriate size.

If it is depressed, on the other hand, the lens 10 is too small and must be replaced with a larger lens.

Actuation of the feeler 17 is sensed by the displacement sensor 24 that it comprises.

To prevent any unnecessary deterioration of the lens 10 the carriage 14 is preferably raised between successive stepwise movements of the support shaft 15 so that the accompanying rotation of the lens 10 occurs when it is not in contact with the grinding wheel 12.

The method is the same if the template 16 is a circular template.

If required, the various operations of the method in accordance with the invention may with advantage be integrated into a special working cycle or sensing cycle of the grinding machine 11 to be carried out prior to any grinding cycle.

The present invention is not limited to the embodiments described but encompasses any variant execution thereof.

Specifically, the grinding wheel could be replaced by a milling tool to form a bevel without departing from the scope of the invention.

Thus in the present context the expression "grinding machine" must be understood as meaning any "trimming machine", whether it is an actual grinding machine or a bevelling machine, and the expression "grinding wheel" must be understood as meaning any cutting or machining tool, whether it is an actual grinding wheel or a milling tool, for example.

There is claimed:

1. Method of checking that a lens suits an eyeglass frame using a grinding machine comprising at least one grinding wheel rotating on a frame, a carriage pivoting on said frame about an axis parallel to the rotation axis of said grinding wheel, a support shaft rotating on said carriage about an axis parallel to the rotation axis of said grinding wheel and adapted to receive axially said lens to be ground and a template, and a feeler vertically aligned with said template, in which method said lens to be ground is mounted on said support shaft and moved into contact with said grinding wheel with the latter stationary, said support shaft is rotated stepwise until said lens to be ground has rotated through one complete turn, and a check is carried out to determine whether said feeler associated with said template is operated thereby during such rotation.

2. Method according to claim 1 wherein said carriage is raised between successive stepwise movements of said support shaft.

3. Method according to claim 1 wherein said feeler comprises a touchpad pivoting on a plate about an axis parallel to the pivot axis of said carriage and a displacement sensor between said touchpad and said plate, actuation of said feeler being sensed by said displacement sensor.

4. Method according to claim 1 wherein the various operations of the method are integrated into a special working cycle or sensing cycle of said grinding machine prior to any grinding cycle.

* * * * *